United States Patent [19]

Jakimowicz et al.

[11] 3,951,751

[45] Apr. 20, 1976

[54] POLLUTANT COLLECTION SYSTEM FOR COKE OVEN DISCHARGE OPERATION

[75] Inventors: Christopher C. Jakimowicz, Detroit; Larry C. Jones, Allen Park; Donald D. Raugh, Grosse Ile, all of Mich.

[73] Assignee: National Steel Corporation, Pittsburgh, Pa.

[22] Filed: July 26, 1974

[21] Appl. No.: 492,261

[52] U.S. Cl. ..... 202/263; 202/253; 202/261; 214/18 R

[51] Int. Cl.[2] ..... C10B 33/00; C10B 39/00

[58] Field of Search ..... 202/253, 262, 263, 261; 214/17 B, 18 R

[56] References Cited

UNITED STATES PATENTS

| | | | |
|---|---|---|---|
| 3,647,636 | 3/1972 | Helm | 202/263 |
| 3,764,026 | 10/1973 | Olah | 202/262 X |
| 3,774,787 | 11/1973 | Ledinsky | 202/262 X |
| 3,801,472 | 4/1974 | Kemmetmueller | 202/263 |
| 3,831,646 | 8/1974 | Gouye | 202/262 X |
| 3,844,900 | 10/1974 | Schulte | 202/262 X |
| 3,846,252 | 11/1974 | Edgar et al. | 202/262 |

FOREIGN PATENTS OR APPLICATIONS

| | | | |
|---|---|---|---|
| 1,421,260 | 7/1960 | Germany | 202/263 |
| 2,038,729 | 10/1972 | Germany | 202/263 |
| 1,202,246 | 10/1965 | Germany | 202/263 |

*Primary Examiner*—Joseph Scovronek
*Assistant Examiner*—Bradley R. Garris
*Attorney, Agent, or Firm*—Shanley, O'Neil and Baker

[57] ABSTRACT

A pollutant collection and exhaust system is provided in a battery of coke ovens for removal of atmospheric pollutants from the gases released at the time of discharge of coke from an oven. A coke guide carriage is provided with an exhaust hood which encloses the coke guide and extends over the transfer car thereby enshrouding the discharging coke and resulting fumes and smoke during the discharge operation. The exhaust hood is movable along the length of the oven battery. A stationary exhaust manifold extends along the battery in spaced relation above the oven exhaust hood. The exhaust hood is equipped with connecting means which are adapted to register in coplanar sealing engagement with selected gated openings in the manifold while simultaneously opening the selected gates. Pollutants are exhausted from the discharge site and conducted through the manifold and associated treating apparatus with draft induced by an exhaust means connected to the manifold and treating apparatus.

2 Claims, 4 Drawing Figures

POLLUTANT COLLECTION SYSTEM FOR COKE OVEN DISCHARGE OPERATION

BACKGROUND OF THE INVENTION

This invention relates to coke production. In one of its aspects this invention relates to the prevention of environmental pollution. In a concept of the invention means are provided for reducing environmental pollution during operation of discharging coke from an oven in a battery of coke ovens.

In the production of coke from coal for use in making steel, the coal is most often treated in a by-product coke oven. This process along with the equipment involved is described in "The Making, Shaping and Treating of Steel,"9th Edition, 1971, pages 109–164, published by U.S. Steel Corporation. At the end of the carbonization period, hot coke is pushed from one side of the oven through the slot-type door at the other side of the oven into an open railcar. Large quantities of atmospheric pollutants, such as smoke and combustion fumes, are released in the general area of contact between the hot coke and air as the hot coke emerges from the oven and bursts into flame.

Recently, the consideration of environmental quality has required that as much atmospheric pollutants as feasible should be kept from entering the atmosphere. Since most of the batteries of coke ovens already in existence do not have provision for containing the pollutants produced in the discharge of coke from an oven, an important consideration in the design of pollution control equipment is that it can be added to the coke handling equipment already in use.

The equipment associated with discharging a coke oven in a battery of ovens has traditionally been a guide rack on a coke guide carriage which is moved on a track along the battery of ovens by a door machine. The door machine removes the coke oven door on the quenching side of a preselected oven and then moves to position the carriage at the particular oven to be pushed. The oven door is also removed from the opposite side of the same oven from which the coke is pushed through the slot-type door and between the coke guides. These guides are vertical walls braced on the carriage sufficiently close together to aid in retaining the coherence of the coke. As the coke passes from between the guides, the large cake of coke extruded through the door opening is no longer supported at the bottom and sides. The coke crumbles in a fiery mass into an open railway car spotted on a track situated sufficiently below the guide car to catch the discharged coke. An oven discharge can produce a considerable quantity of smokey gas at about 1000°F. initial discharge temperature.

In general, the equipment necessary for removing atmospheric pollutants during the discharge of coke from an oven includes a shielding or hood device for surrounding the discharged material and an induced draft means for withdrawing or exhausting the pollutants together with ambient air from this hood and exhausting the air and pollutants in a closed duct to a removed area where the air carrying the pollutants can be treated to remove the polluting material. By the use of such apparatus as gas scrubbers and separators, the pollutants can be collected and the cleaned air released to the atmosphere.

The present invention concerns a mobile exhaust or collection hood attached to a coke guide carriage adapted for the collection of pollutant containing air at a multiplicity of oven discharge sites along a coke oven battery with means for conducting the collected pollutants into a stationary exhaust manifold header.

DETAILED DESCRIPTION

Figure 1:
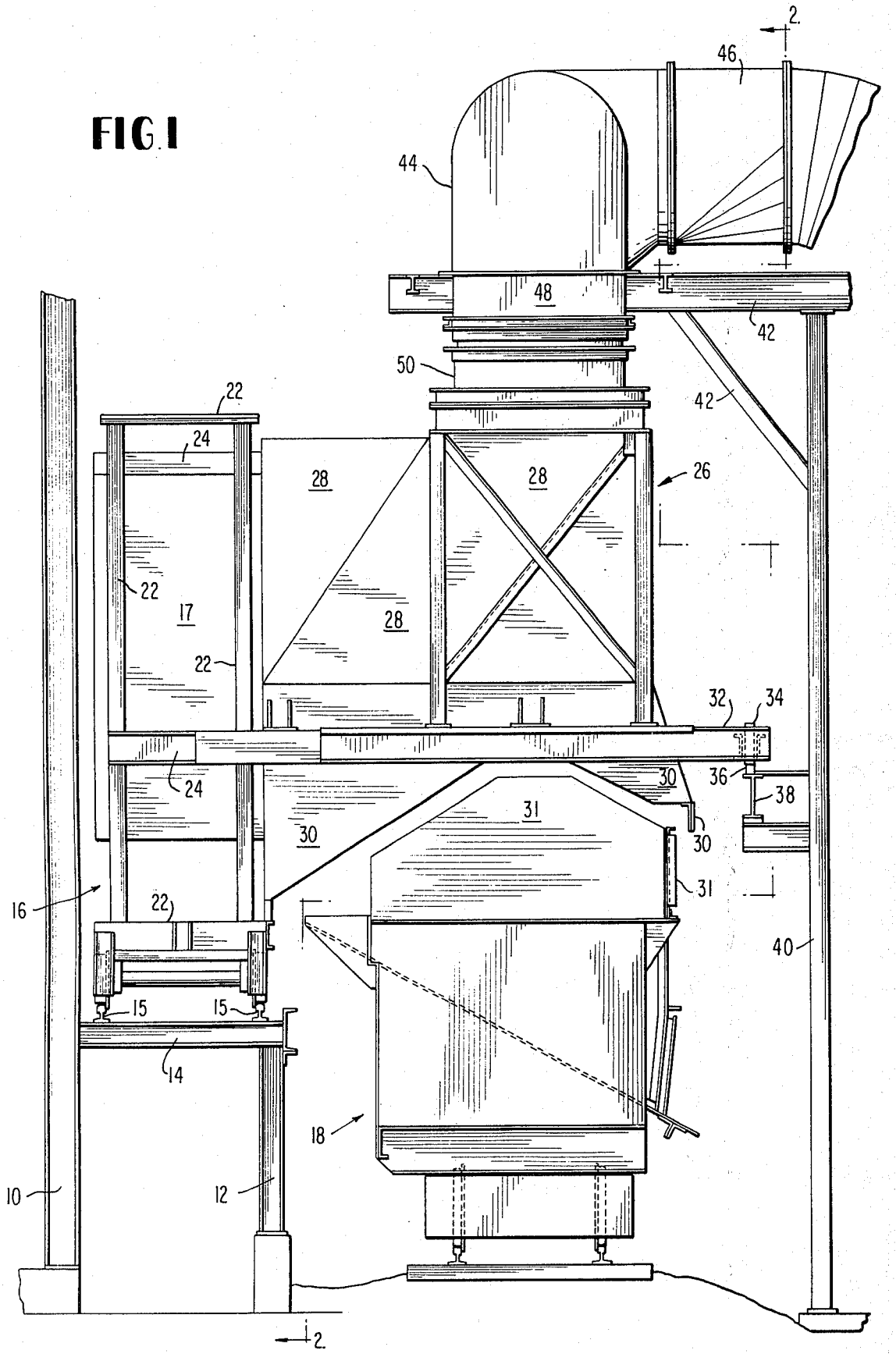
FIG. 1 is a front elevation of a transfer car, exhaust hood, stationary exhaust manifold and telescopic conduit means connected to the hood for establishing sealing registering with a stationary exhaust manifold.
Figure 2:
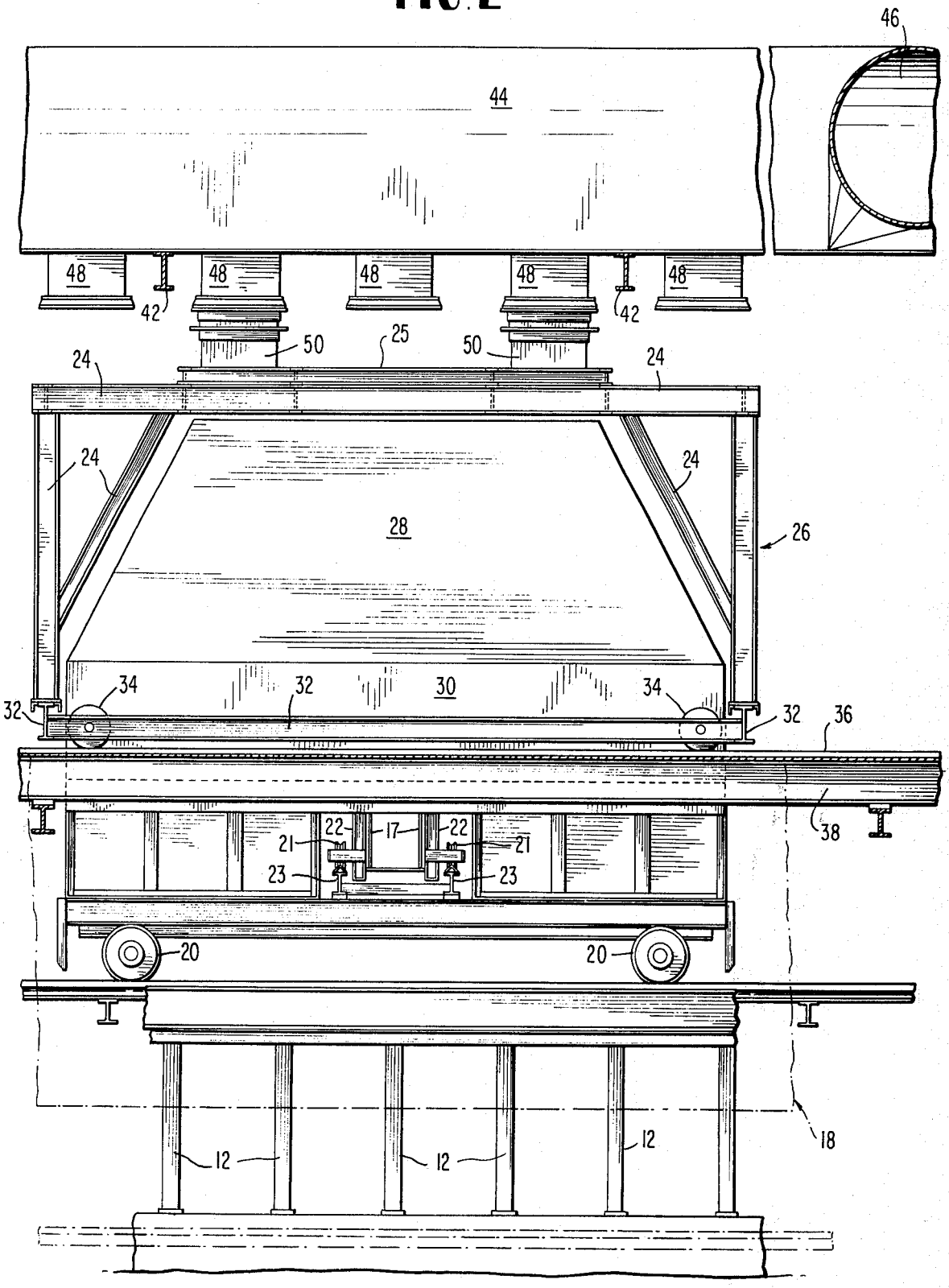
FIG. 2 is a view taken along line 2—2 of FIG. 1 showing a side elevation with parts broken away of the same structure with the transfer car of FIG. 1 shown in phantom.

Referring to FIGS. 1 and 2, a line of supporting stanchions 10 are spaced along the length of a battery of coke ovens (not shown) on the coke discharge side thereof. A series of short columns 12 extending along the length of the battery support beams 14 which in turn support rails 15 which run the length of the battery. A coke guide car indicated generally at 16 is driven by a door machine (not shown) along the length of the battery. The coke guide car can be positioned in front of any oven being discharged with a coke guide member 17 on either side of the oven to restrain the block of coke against disintegration prior to its reaching the transfer car indicated generally at 18. The transfer car can be positioned anywhere along the length of the coke oven battery to receive the coke being discharged from an oven between the coke guide members of the coke guide car.

The coke guide car runs longitudinally of the battery on wheels 20 and is movable toward and away from an oven door on wheels 21 running on rails 23. The frame 22 of the coke guide car, by means of supplemental framework 24, carries an exhaust hood indicated generally at 26 which enlarges outwardly from the coke guide car frame 22 to encompass and enclose the space above transfer car 18. The exhaust hood supporting framework 24 carries stainless steel sheets 28 which form the enclosing side and top walls of the exhaust hood, the exhaust hood being open downwardly and having skirts 30 approaching the upper edges of the side and end walls 31 of the transfer car as closely as practicable consistent with the movement of the transfer car relative to the exhaust hood structure. The sheets 28 of hood 26 are attached onto a framework that is supported by 24. This feature permits ease in removal of sectors or panels 28 and replacement without disturbance of other sheets or the hood proper 26. A framework formed from beams 32 constitutes part of the hood supporting framework 24 and extends outwardly beyond the vertical projection of transfer car 18. This framework carries wheels 34 which ride on rail 36 carried by a girder 38 running the length of the battery. Girder 38 in turn is carried by vertical columns 40.

Columns 40, through the medium of trusswork 42, support an exhaust manifold 44 which runs along the length of the coke oven battery directly above exhaust hood 26 and transfer car 18. Lateral extensions 46 of this manifold go to gas treating and gas exhaust means. Exhaust manifold 44 has a flat bottom and a plurality of downwardly directed openings, in number and position the same as the coke oven doors. The exhaust manifold's flat bottom permits ease of installation and alignment with respect to the required tolerances built into the system while the semi-circular top improves the velocity profile of the collected gases while reducing dust and ice build-up on the outside of manifold 44. Exhaust hood 26 has a pair of upwardly directed openings positioned to register with alternate downwardly facing openings in exhaust manifold 44. By virtue of short downwardly directed ducts 48 for each opening in the exhaust manifold and upwardly directed stacks 50 associated with the openings in the exhaust hood, movement of the exhaust hood along the length of the coke battery makes possible connection of the exhaust hood with the exhaust manifold at any two alternately spaced ducts 48 and stacks 50. Ducts 48 have their lower ends closed by gates 52, 52 and stacks 50 are telescopically received within the upper portion of exhaust hood 26. When positioned in alignment with two alternately spaced ducts 48, upward movement of stacks 50 brings the associated ducts and stacks into sealing registry and at the same time opens gates 52 by structure to be described.

Figure 3:
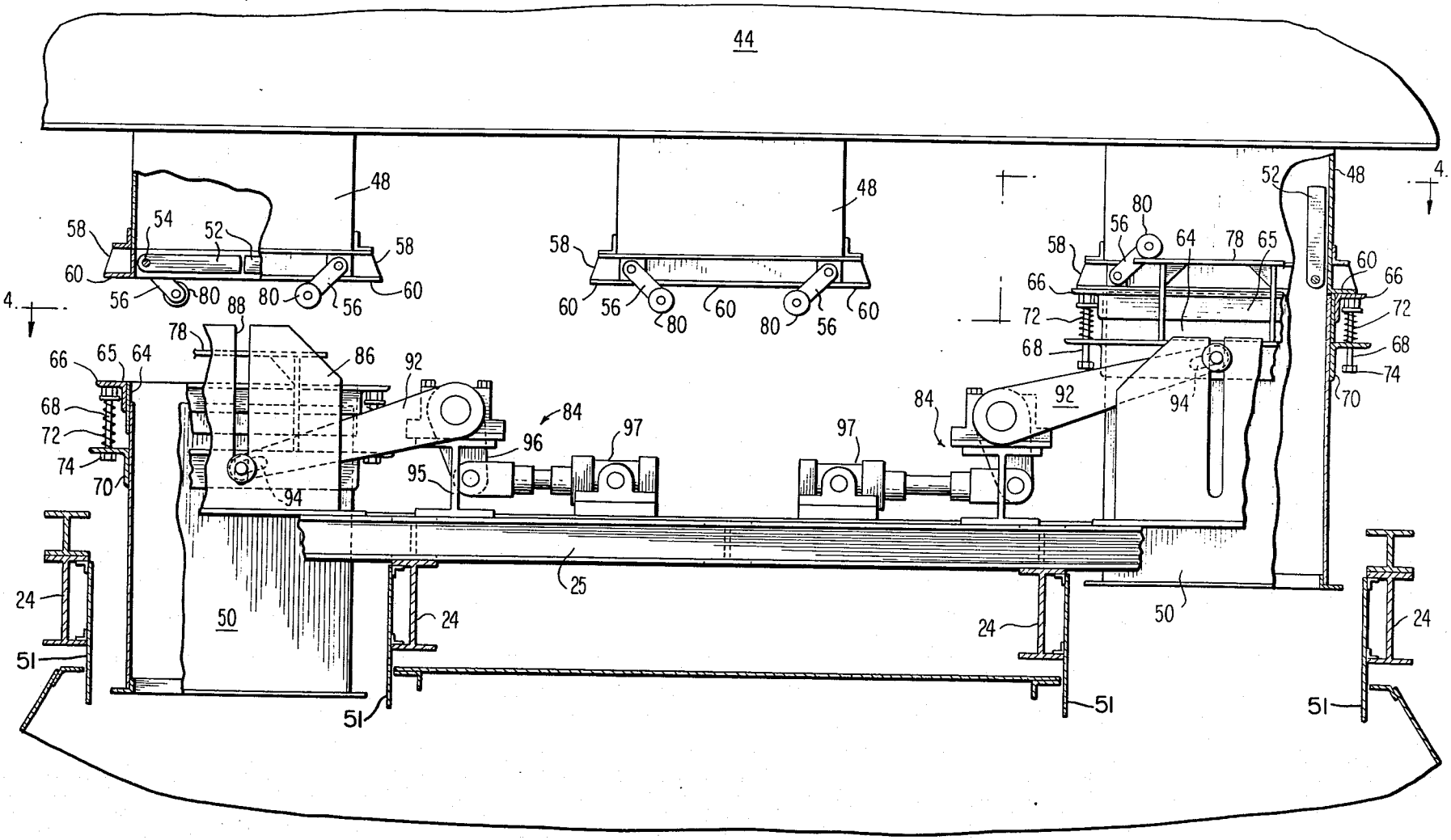
FIG. 3 is an enlarged view in side elevation showing the sealing means carried by the exhaust hood in conjunction with the sealing means for the exhaust openings.
Figure 4:
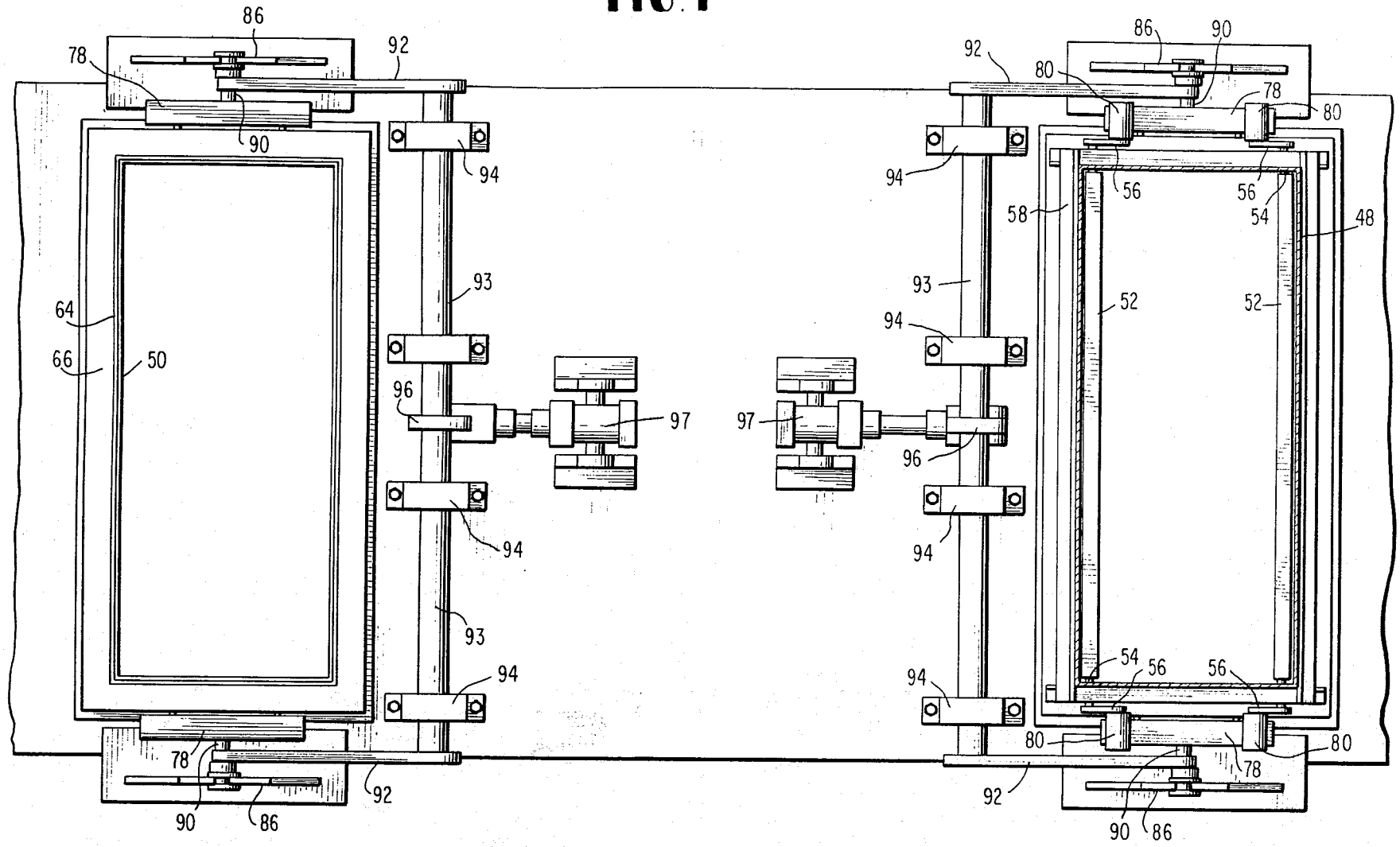
FIG. 4 is a plan view of the top of an exhaust hood, with parts in section along the section lines 4—4 of FIG. 3, showing for purposes of better illustration similar parts in different positions.

Referring now to FIGS. 3 and 4 which are enlarged views of three adjacent ducts 48 and the two spaced stacks 50 of exhaust car 26, the mechanisms for achieving sealed connection between ducts 48 and stacks 50 are illustrated.

Each duct 48 is closed at its lower end by a pair of gates 52 pivoted along their outer edges at pivots 54, 54 so as to swing up to open and down to come together to close the duct. Each gate has at each end of its pivot pin 54 an operating member 56 located outside of the duct but with rigid connection to the pivot pins of the gate whereby upward movement of the operating members 56 will open the associated gate. Gate operating member 56 comprise lever arms disposed at about 45° to the associated gates so that at their uppermost point of movement their centers of gravity are located relative to pivot pins 54 so that their weight in addition to the weight of gate 52 closes the associated gate when the arm is unsupported.

Each duct 48 carries at its lower end a reinforcing member 58 presenting a downwardly facing horizontal flange surface 60 flush with the bottom edge of duct 48. The reinforcing flange 58 is attached to duct 48 by a series of bolts which then permit ease in removal of the gate assembly without disturbance of the manifold 44 if replacement of the gate assembly is required. As will be pointed out below, planar flange surfaces 60 have a sealing function in conjunction with complementary planar surface structures at the upper ends of exhaust stacks 50.

Turning now to the exhaust stacks 50 of hood 26, each exhaust stack is telescopically received in an opening in the top of the exhaust hood formed by sheets 51, the length of the stacks being such that upward movement of a stack from a telescoped position within the exhaust hood brings the upper end of the stack into engagement with the lower end of the duct 48 which is registered therewith. In order to achieve a sealing connection between the upper end of a stack and the lower end of a duct which will allow as great a tolerance as practicable relative to registry while at the same time permitting accidental relative, lateral movement of the hood and the exhaust manifold without damage to the sealing parts, an ingenious surface to surface yieldable seal has been developed by applicants.

Each stack 50 carries at its upper end a slideable snugly fitting sleeve 64 which in turn carries an angle iron or reinforcing flange 65 having a horizontal surface 66 constituting a complementary sealing surface for engagement with flange 60 on the lower end of the associated duct 48. A plurality of guide rods 68 have their upper ends affixed to flange 65 and their lower ends passing freely through a flange 70 affixed to the wall of the stack. Compression springs 72 on these guide rods urge sleeve 64 to its uppermost position as determined by the restraining head 74 on the lower end of each guide rod 68. It will be evident that with a duct 48 properly aligned with a stack 50, upward movement of stack 50 will bring flange surfaces 60 and 66 into contact. A practicable amount of play or tolerance between sliding sleeve 64 and the upper end of its stack 50, taken with the biasing action of springs 72, will assure a satisfactory surface to surface sealing engagement between surfaces 60 and 66, despite the usual departures from perfection of juxta position found in the field.

In order to open gates 52 automatically at the time sealing engagement is made between surfaces 60 and 66, each stack 50 carries an operating bar 78 rigidly connected to flange 70, which operating bar has a horizontal flat surface for engaging the two laterally extending protuberances 80 carried by valve actuating members 56. The operating bar 78 is adjusted to achieve desired opening of the gates 52 by the use of shims placed below the supporting steel of bar 78 before bolting in place onto flange 70. As best seen on the right hand side of FIG. 3, extreme upward movement of stack 50 causes operating element 78 to move valve actuating members 56 and thereby valves 52, 52 into uppermost, open position.

In order to achieve satisfactory sealing between surfaces 60 and 66 springs 72 must exert appreciable force and an equal or greater force must be exerted in the raising of each stack 50 from its telescoped position within the exhaust hood to the extended position for sealing connection with the associated ducts 48. This desired movement and sealing pressure is achieved by the mechanism indicated generally by reference numerals 84. This mechanism for each exhaust stack comprises a vertical movement translating plate 86 on each side of the stack rigidly mounted on the top of the exhaust hood and incorporating a vertical slot 88, a pin 90 and an actuating crank arm 92 connected to pin 90 by means of a slot 94. Pin 90 is rigidly mounted on angle iron 70 of the stack. Movement of crank arm 92 from the position shown on the left hand side of FIG. 3 to the position shown on the right hand side of FIG. 3 raises the associated stack 50 from its lowermost position to its uppermost position in registry with the aligned duct 48. As the associated stack and duct come into registry, surface 66 of angle iron 65 is pressed against surface 60 of reinforcing member 58, sleeve 64 slipping downwardly on stack 50 against the force of compression spring 72. The force with which surfaces 66 and 60 are brought together, the resilience of springs 72 and the working tolerance between sleeve 64 and the stack result in a good sealing action between surfaces 60 and 66. However, this necessary force would place too great a stress upon the supporting framework 24, 32, of exhaust hood 26 if it were not for the provision of wheels 34 and rail 36 supported by column 40.

Crank arms 92 are rigidly carried on shafts 93 rotatably supported in bearings 94 carried on support members 95 connected to framework 25 of the exhaust hood 26. Rigidly connected to each shaft 93 is an operating crank arm 96 which is actuated by a hydraulic jack 97. The entire stack mechanism is rigidly attached to a framework 25 which, in turn, is attached to the rigid support frame 24 by means of bolted attachment. This permits ease in removal of the stack assembly, for required repairs or replacement, without disturbance to rigid frame 24 or hood 28.

Suitable controls are utilized to control movements of the transfer car and the coke guide car and actuation of jacks 97 so that the coke guide car is lined up with the oven to be pushed or discharged, the transfer car is under hood 26 and a pair of alternately spaced ducts and stacks are aligned with each other to be brought into sealing engagement prior to the time the oven is discharged. These controls are such as to prevent movement of the components of the system while the stacks and ducts are in sealing registry. However, small disrupting movements of this nature can occur occasionally during everyday operation of a plant, but the coplanar sealing engagement between the stacks and the ducts in the present invention eliminate the possibility of damage to these parts by such movement.

For convenience in claiming, a duct 48 together with its associated sealing mechanism and a stack or conduit 50 together with its associated sealing mechanism, or functional equivalent structure in either case, are termed sealing means in the appended claims.

The above embodiments are to be considered in all respects as illustrative and not restrictive since the invention may be embodied in other specific forms without departing from its spirit or essential characteristics. Therefore, the scope of the invention is indicated by the claims rather than by the foregoing description, and all changes which come within the meaning and range of the equivalents of the claims are intended to be embraced therein.

We claim:

1. In a coke oven battery air pollution prevention system including a transfer car for receiving the coke discharged from an oven, a coke guide mounted on a carriage for movement along the length of the battery, an exhaust hood carried by the coke guide carriage, the exhaust hood being shaped to enclose the coke guide and to extend outwardly from the coke guide carriage to form an enclosure projecting over and enclosing the open top of the transfer car, a stationary exhaust manifold positioned above and in spaced relation to the exhaust hood and extending along the length of the battery, means forming a plurality of exhaust openings in the exhaust manifold corresponding in spacing to the spacing between coke oven doors, exhaust manifold sealing means surrounding each opening in the exhaust manifold, gate means for closing each opening in the exhaust manifold, means for mounting the gate means and biasing the gate means toward closed position, gate opening means for opening each gate means, means forming an opening in the exhaust hood positioned for registry with any one of a plurality of the openings in the exhaust manifold as the coke guide carriage is moved along the length of the battery, exhaust hood sealing means carried by the exhaust hood surrounding the opening in the exhaust hood and movable into sealing engagement with an exhaust manifold sealing means which is in registry with the opening in the exhaust hood, and means associated with the exhaust hood for actuating the gate opening means for opening the associated gate means in conjunction with movement of the exhaust hood sealing means into sealing engagement with the sealing means on the associated opening in the exhaust manifold, the sealing means of the exhaust manifold and the sealing means of the exhaust hood each having a planar sealing face, the planar faces being in coplanar relation when in sealing contact, the improvement wherein the exhaust hood sealing means comprise:

a. a conduit open at both ends telescopically received in the opening in the exhaust hood, b. a sleeve slideably mounted on the upper end of the conduit, c. a reinforcing member surrounding the upper end of the sleeve, d. the reinforcing member having an upwardly directed planar sealing face, the upwardly directed planar sealing face constituting the uppermost portion of the conduit when the upwardly directed planar sealing face is in its uppermost position, e. resilient means acting between the conduit and the sleeve urging the sleeve upwardly, and f. means for moving the conduit in an upward direction for resilient engagement of the planar sealing face on the reinforcing member with the planar face of the exhaust manifold sealing means, the upper portion of the conduit extending above the uppermost portion of the exhaust hood.

2. The system of claim 1 in which the means for opening each gate means comprise g. a lever arm attached to the means for mounting the gate means, h. the lever arm extending at an angle in the neighborhood of 45° below the horizontal when the gate means is closed and terminating in a laterally extending protrusion, the lever arm holding the associated gate means in closed position by gravity, i. elongated, flat, horizontal bar means carried by the conduit and located outwardly of the lever arm and extending in the direction of movement of the exhaust hood along the length of the battery for engaging the protrusion to move the lever arm upwardly as the conduit moves upwardly in the neighborhood of 90° to thereby open the gate means in the exhaust manifold when the exhaust manifold sealing means and the exhaust hood sealing means are in sealing relation.

* * * * *